United States Patent [19]

Bauer

[11] 4,066,225

[45] Jan. 3, 1978

[54] REEL FOR CABLES, WIRES, AND THE LIKE

[75] Inventor: Ernst Bauer, Neustadt, Coburg, Germany

[73] Assignee: Industriewerk Nachf. Seifert & Co. KG, Neustadt near Coburg, Germany

[21] Appl. No.: 706,416

[22] Filed: July 19, 1976

[30] Foreign Application Priority Data

July 18, 1975 Germany ..... 2532156

[51] Int. Cl.[2] ..... B65H 75/14

[52] U.S. Cl. ..... 242/118.8; 242/77.3

[58] Field of Search ..... 242/118.8, 118.7, 118.61, 242/77.3, 77.4, 118.4, 77, 118.62

[56] References Cited

U.S. PATENT DOCUMENTS

| | | | |
|---|---|---|---|
| 536,663 | 4/1895 | Stevenson | 242/118.8 |
| 962,654 | 6/1910 | Mossberg | 242/77.4 |
| 3,108,758 | 10/1963 | Hill | 242/77.3 |
| 3,542,308 | 11/1970 | Starratt | 242/118.8 |
| 3,743,208 | 7/1973 | Schmitz | 242/118.8 |

*Primary Examiner*—George F. Mautz

*Attorney, Agent, or Firm*—Frank J. Jordan

[57] ABSTRACT

A reel for cables, wires or the like having a core and a central bore hole in the core for the mounting of a spindle sleeve or the spindle of a processing machine includes hub means on the longitudinal ends of the core, the hub means having an outer cylindrical bore hole juxtaposed to an inner conical bore hole with the outer cylindrical bore hole being of a larger diameter than the largest diameter of the conical bore hole.

1 Claim, 2 Drawing Figures

REEL FOR CABLES, WIRES, AND THE LIKE

BACKGROUND OF THE INVENTION

The invention relates to a reel for cables, wires or similar materials, and particularly to a fast running reel with a center hole in the reel core for the mounting of the spindle sleeve or the spindle of a processing machine, such as a drawing machine, twisting machine, stranding machine, or the like.

The usual processing machines are provided with a cylindrical spindle sleeve or spreading spindle for the acceptance of the material to be processed. Other known machines are provided with a conical spindle. With these known arrangements separate reels are required for each mounting system, and the customary reels cannot be transferred from one mounting system to the other, thereby resulting in an unpractical arrangement. Accordingly, there is a need to provide an improvement, and to construct a reel which may be used for both mounting systems on the process machinery.

According to the present invention, this objective is achieved by providing the hub of the reel with an outer cylindrical bore hole of a larger diameter and an inner conical bore hole of a lesser diameter. Both bore holes may, as the invention provides, be offset against each other by a step.

Any increased expense in the fabrication of the hub of such reels is offset by their universal usability in all customary systems of mounting, and the exchangeability of the reels for all mountings results in a distinct advantage.

Other features which are considered characteristic of the invention are set forth in the appended claims.

Although the invention is illustrated and described in relationship to specific embodiments, it is nevertheless not intended to be limited to the details shown, since various modifications and structural changes may be made therein without departing from the spirit of the invention and within the scope and range of equivalents of the claims.

The construction and operation of the invention, however, together with additional objects and advantages thereof will be best understood from the following description of specific embodiments when read in connection with the accompanying drawings.

SUMMARY OF THE INVENTION

A reel for cables, wires or the like has a core and a central bore hole in the core for the mounting of a spindle sleeve or the spindle of a processing machine. Hub means are provided on the longitudinal ends of the central bore hole, and means are provided on the hub defining an outer cylindrical bore hole juxtaposed to an inner conical bore hole, with the outer cylindrical bore hole being of a larger diameter than the largest diameter of the conical bore hole.

DESCRIPTION OF THE PREFERRED EMBODIMENTS

Figure 1:
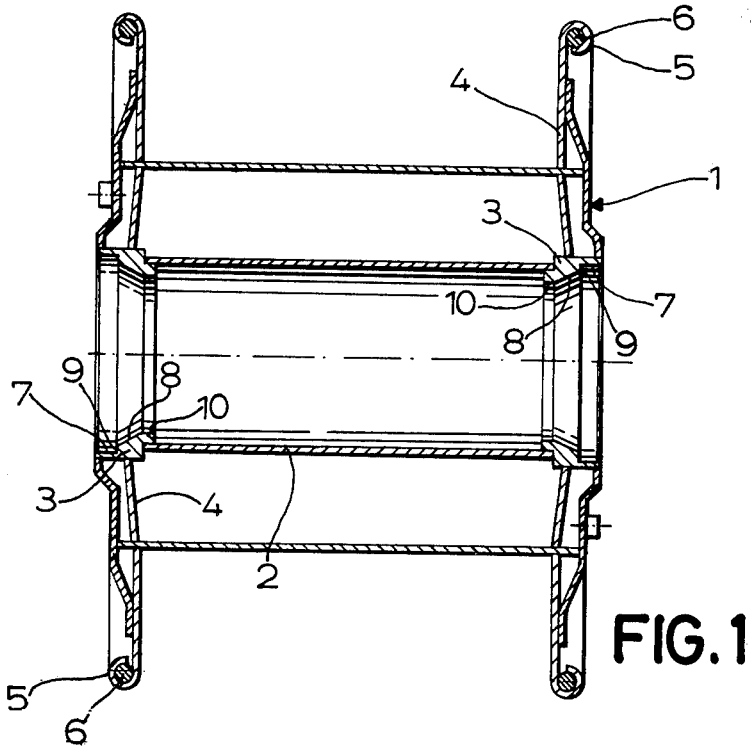
FIG. 1 is an axial sectional view of a reel according to the present invention.
Figure 2:
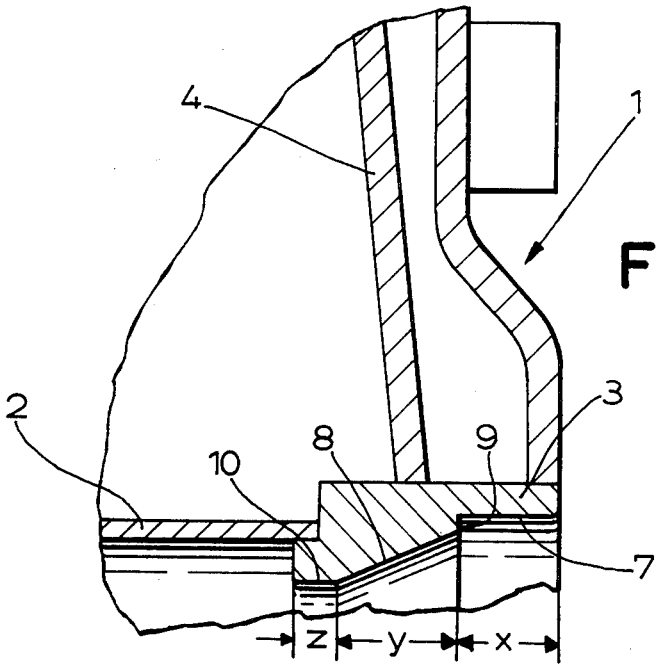
FIG. 2 is a partial sectional view, on an enlarged scale, showing a portion of the hub.

A reel 1 shown in the drawings is mainly useful for receiving wires, cables, stranded wire, and similar products and comprises a cylindrical core 2 which is provided at each of its longitudianl ends with a hub 3. To the outer circumference of the hub 3, there are fastened head flanges, the outer rim 5 of head flange 4 being outwardly flanged and carrying a reinforcing means 6.

The hub 3 is constructed from the outside towards the inside with a cylindrical bore hole 7 with an axial length *x*, and a conical bore hole 8 of an axial length *y*, the cone-angle of which is shown in the example of the illustrated embodiment as 22.5°. The largest diameter of this conical bore hole 8 is smaller than the diameter of the outer cylindrical bore hole 7. The bore hole 7 and the conical bore hole 8 are offset relative to each other by the step 9. At the inner end of the conical bore hole 8 is an additional cylindrical bore hole 10 having an axial length *z*.

It is thought that the invention and many of its attendant advantages will be understood from the foregoing description and that it will be apparent that various changes may be made in the form, construction, and arrangements of the parts without departing from the spirit and scope of the invention or sacrificing all of its material advantages. The form heretofore described being merely a preferred embodiment thereof.

What is claimed is:

1. A reel for cables, wires or the like having a core and a central bore hole in the core for the mounting of both cylindrical and conical spindles of a processing machine, comprising hub means on the longitudinal ends of said central bore hole, means on said hub means defining an outer cylindrical bore hole axially juxtaposed to an inner conical bore hole, said outer cylindrical bore hole being of a larger diameter than the largest diameter of said conical bore hole, said outer cylindrical bore hole extending to the longitudinal end of said core, said conical bore hole having its large diameter disposed axially outwardly and terminating by a radial flange portion which also terminates the axially inner end of said outer cylindrical bore hole to thereby define a step between said outer cylindrical bore hole and said conical bore hole, said outer cylindrical bore hole having an axial length operable to receive and be supported by said cylindrical spindle, said conical bore hole being operable to receive and be supported by said conical spindle, an axially inner cylindrical bore hole juxtaposed to said conical bore hole, said inner cylindrical bore hole having a diameter substantially equal to the smallest diameter of said conical bore hole, said core being defined by a cylindrical sleeve member extending from said hub means, said cylindrical sleeve member being fitted on an axially inner cylindrical portion of said hub means, said axially inner cylindrical portion being radially opposite said inner cylindrical bore hole, and head flanges extending radially from said hub means.

* * * * *